US005642862A

United States Patent [19]

Wakeman et al.

[11] Patent Number: 5,642,862

[45] Date of Patent: Jul. 1, 1997

[54] FUEL INJECTION VALVE HAVING A GUIDE DIAPHRAGM AND METHOD FOR ASSEMBLING

[75] Inventors: Russell J. Wakeman, Canton, Mich.; John Bergstrom, Singapore, Singapore

[73] Assignee: Siemens Automotive Corporation, Auburn Hills, Mich.

[21] Appl. No.: 508,495

[22] Filed: Jul. 28, 1995

[51] Int. Cl.[6] ..... B05B 1/30; F02M 51/00

[52] U.S. Cl. ..... 239/585.4

[58] Field of Search ..... 239/585.1–585.5, 239/533.3–533.12; 251/129.15, 129.21

[56] References Cited

U.S. PATENT DOCUMENTS

| | | | |
|---|---|---|---|
| 4,946,107 | 8/1990 | Hunt | 239/585.4 |
| 5,236,173 | 8/1993 | Wakeman | 239/585.4 X |
| 5,350,119 | 9/1994 | Bergstrom | 239/585.4 |
| 5,494,223 | 2/1996 | Hall et al. | 239/585.5 |

FOREIGN PATENT DOCUMENTS

| | | | |
|---|---|---|---|
| 2834844 | 3/1979 | Germany | 239/585.5 |
| 3427526 | 2/1986 | Germany | 239/585.4 |

*Primary Examiner*—Kevin Weldon
*Attorney, Agent, or Firm*—Russel C. Wells

[57] ABSTRACT

A fuel injection valve for an engine fuel injection system includes a valve housing, a valve seat fixedly secured to the valve housing and a valve needle movable axially and co-operably engageable with the valve seat. The fuel injection valve also includes a diaphragm that aligns the needle with the valve seat. The diaphragm has an outer zone attached to the housing and an inner zone attached to the needle, such that the inner zone of the diaphragm moves in unison with the needle to thereby avoid frictional sliding contact between the needle and the diaphragm. Alignment of the needle with the valve seat may be assured by assembly wherein the diaphragm is first fixed to the needle and the needle is then seated upon the valve seat prior to clamping of the outer zone of the diaphragm to the housing while the needle is seated.

5 Claims, 3 Drawing Sheets

FUEL INJECTION VALVE HAVING A GUIDE DIAPHRAGM AND METHOD FOR ASSEMBLING

FIELD OF THE INVENTION

This invention relates to fuel injection valves for engine fuel injection systems.

BACKGROUND OF THE INVENTION

The prior art includes various fuel injection valve arrangements wherein a guide member is provided to align a valve needle with a valve seat. Typically, the valve needle extends through a central guide opening in the guide member such that the guide member engages the valve needle and restrains it from radial motion as the needle moves axially. As a result, the needle and guide member are subject to friction and wear as the needle slides against the guide member.

SUMMARY OF THE INVENTION

The present invention provides a fuel injection valve for an engine fuel injection system having a guide member in the form of a guide diaphragm that is attached to the valve needle. It reduces friction and avoids wear in the guide member and needle by avoiding frictional sliding contact between the guide diaphragm and the valve needle.

More specifically, a fuel injection valve of the present invention comprises a valve seat adapted to be fixedly secured to a valve housing, a valve needle movable in an axial direction and co-operably engageable with the valve seat, and a diaphragm that aligns the needle with the valve seat. The diaphragm has an outer zone adapted to be secured to the valve housing and an inner zone attached to the needle such that the inner zone of the diaphragm moves in unison with the needle to thereby avoid frictional sliding contact between the needle and the diaphragm. The diaphragm also includes an axially resilient intermediate zone connecting the inner zone to the outer zone and allowing the inner zone to move in unison with the needle. The intermediate zone also applies in a radial restraining force between the inner and outer zones to maintain axial alignment of the valve needle with the valve seat.

In one embodiment of the invention, the intermediate zone includes a plurality of radially extending spring elements.

In another embodiment, the intermediate zone includes at least one axially resilient convolution.

In yet another embodiment of the invention, the intermediate zone is arched in the manner of a snap disk.

The present invention also includes a method for assembling a fuel injection valve according to the invention. The method includes the steps of affixing the inner zone of the diaphragm to the valve needle, assembling the needle and diaphragm assembly into the valve housing, seating the valve needle upon the valve seat, and thereafter securing the outer zone of the diaphragm relative to the valve housing and valve seat. The securing step may be performed by clamping the outer zone of the diaphragm between the valve housing and valve seat.

These and other features and advantages of the invention will be more fully understood from the following detailed description of the invention taken together with the accompanying drawings.

DETAILED DESCRIPTION OF THE INVENTION

Figure 1:
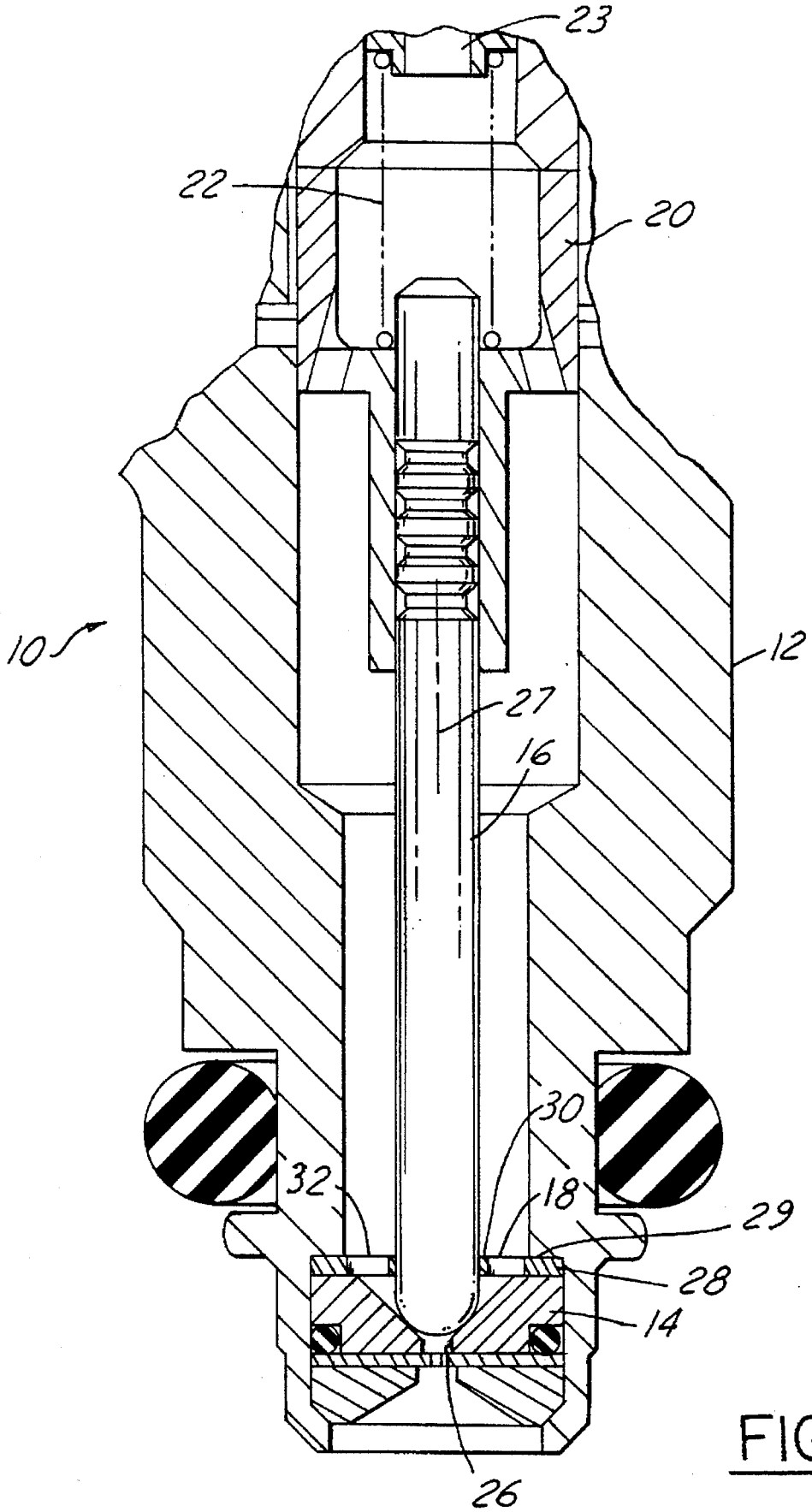
FIG. 1 is a partial cross-sectional view of the nozzle end of a fuel injection valve for an engine fuel injection system according to the present invention.

Referring now to FIG. 1, there is shown an electromagnetic fuel injection valve formed according to the invention and generally indicated by numeral 10. The fuel injection valve 10 is operable by means of a solenoid 11 which is illustrated by a box in FIG. 1 to inject fuel into an internal combustion engine induction system (not shown). The fuel injection valve forms part of an engine fuel injection system. The valve 10 includes a valve body 12 and a valve seat 14 fixedly secured to the valve body 12. A valve needle 16 is reciprocally movable in an axial direction within the valve 10 and is co-operably engageable with the valve seat 14 to shut off fuel flow. In accordance with the invention a diaphragm 18 guides or aligns the needle 16 with the valve seat 14.

An armature 20 is secured to the needle 16 within the valve body 12 for axial movement between a first position wherein the needle 16 is engaged with the valve seat 14 and a second position wherein the needle 16 is spaced from valve seat 14 to allow fuel flow through the valve 10. A spring 22 is positioned between a pole piece 23 and the armature 20 for applying a spring force to bias the armature 20 toward the first position. As is well known in the art, the solenoid 11 is in the valve 10 for applying magnetic force to oppose the spring force and move the armature 20 into the second position. The valve seat 14 includes a valve aperture 26. In the first position, the needle 16 engages the valve seat 14 in such a manner as to close or block the valve aperture 26. In the second position, the needle 16 is spaced from the valve seat 14 to allow fuel flow through the valve aperture 26. Reciprocal movement of the needle 16 and the armature 20 is reciprocally along an axis 27.

According to the present invention, the guide diaphragm 18 includes an outer zone 28 that is clamped between a shoulder 29 in the valve body 12 and the valve seat 14 as illustrated in FIG. 1. The guide diaphragm 18 also includes an inner zone 30 having a needle aperture 40 which is attached to the needle 16 such that it moves in unison with needle 16 as the needle moves between the first and second positions. In this manner, frictional sliding contact between the needle 16 and the diaphragm 18 is avoided. The diaphragm 18 further includes an axially resilient intermediate zone 32 connecting the inner zone 30 to the outer zone 28. This allows the inner zone 30 to move axially in unison with the needle 16 and applies a radial restraining force between the inner and outer zones 28, 30 to maintain the radial relation of the inner zone 30 relative to the outer zone 28 which in turn maintains the axial alignment of the needle 16 and the valve seat 14.

Referring now to FIGS. 2–5, there are shown various embodiments of guide diaphragms which could form part of a fuel injection valve according to the invention. Because some of the details of these diaphragm embodiments have similar components or parts, as in the diaphragm 18 shown in FIG. 1, similarly the units and tens digits of the ending numerals are used for like or similar parts or elements. Thus, 28, 128, 228, 328, 428 and 528 all refer to the outer zone of each embodiment. The radial restraining force is low and sufficient to maintain the axial movement of the needle 16.

Figure 2:
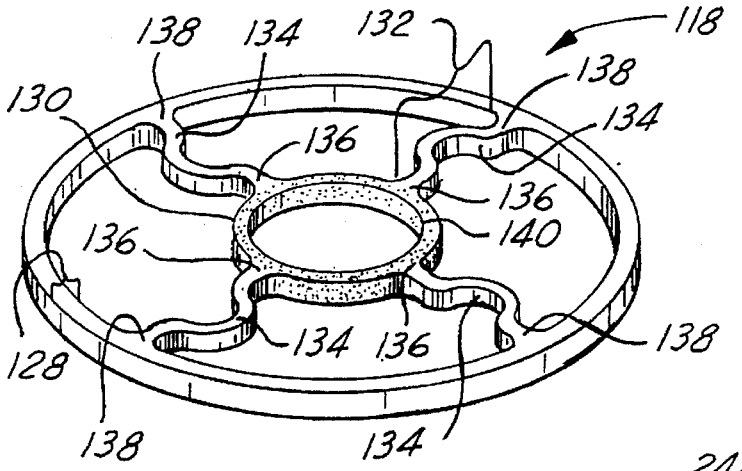
FIG. 2 is a perspective view of one embodiment of a guide diaphragm according to the invention.

Referring now to FIG. 2, one embodiment of a guide diaphragm for a fuel injection valve according to the invention is shown and is generally indicated by numeral 118. The diaphragm 118 includes an outer zone 128, an inner zone 130 and an intermediate zone 132. The intermediate zone 132 connects the inner zone 130 to the outer zone 128 allowing the inner zone 130 to move in unison with the needle 16 and applies a radial restraining force between the inner 130 and outer zones 128 to maintain the radial location of the inner zone 130 relative to the outer zone 128.

The intermediate zone 132 includes a plurality of radially extending spring elements 134. Each spring element 134 includes a curved flexible member connected to the inner zone 130 at a first end 136 and connected to the outer zone 128 at a second end 138. The intermediate zone 132, 232, 332, 432 and 532 moves or stretches in both an axial and radial direction. The diaphragm 118 may be constructed from silicon wherein a silicon sheet is chemically micro-machined to form the inner zone 130 and the intermediate zone 132. The inner zone 130 includes a needle aperture 140 having a diameter approximately equal to the outside diameter of the needle 16 so that the needle 16 may be inserted into the aperture 140 and extend therethrough. The inner zone 130 may be metalized, that is, combined with a metal and then secured, such as by brazing, to the needle 16.

In the preferred embodiment of FIG. 2, the diaphragm is micro-machined from a silicon sheet. In using a silicon sheet, the properties of the diaphragm and the spring constants of each spring element 134 are identical. Silicon micro-machining is a very accurate process thereby the physical and dimensional characteristics of each spring element 134 is the same. The loop formed in each spring element 134 functions to flatten thereby extending each spring element uniformly as the needle reciprocates.

Figure 3:
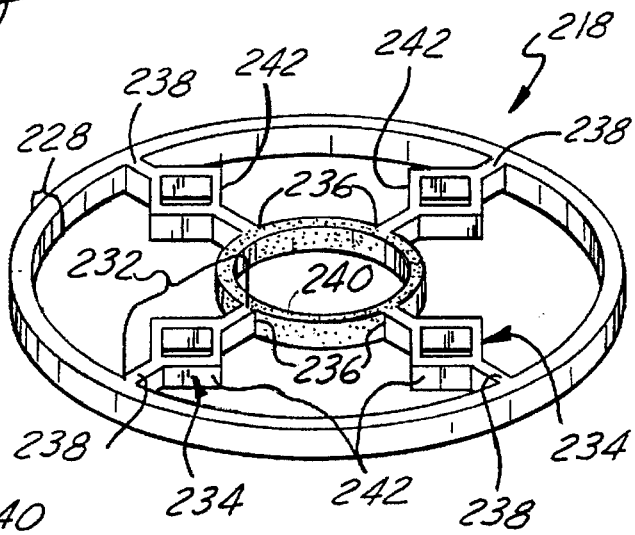
FIG. 3 is a perspective view of another embodiment of a guide diaphragm according to the invention.

Referring now to FIG. 3, another embodiment of diaphragm for a fuel injection valve according to the invention is shown and generally indicated by numeral 218. With this embodiment, the spring elements 234 each include a diamond-shaped member 242. The diaphragm 218 may also be constructed from silicon and formed by chemical micro-machining. Also, the inner zone or ring 230 may be metalized for attachment to the needle 16. The diamond-shaped members 242 stretch as the needle reciprocates.

Figure 4:
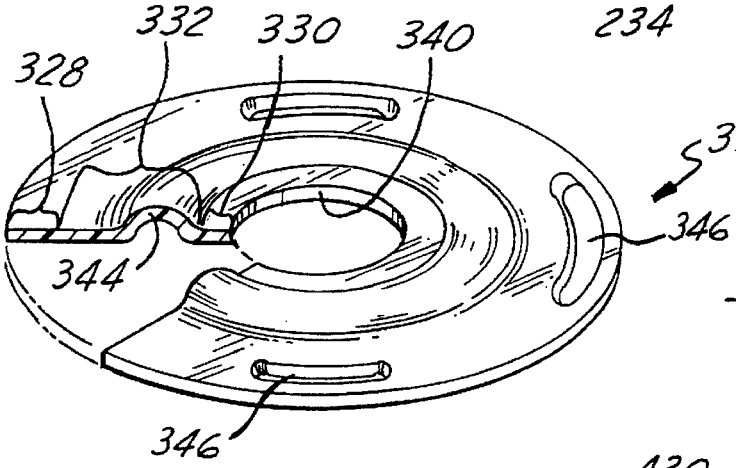
FIG. 4 is a perspective view of still another embodiment of a guide diaphragm according to the invention.

Referring now to FIG. 4, yet another embodiment of a diaphragm for a fuel injection valve according to the invention is shown and generally indicated by numeral 318. The intermediate zone 332 of the guide diaphragm 318 includes at least one axially resilient convolution 344. The guide diaphragm 318 may be constructed from a metal, such as steel or micro-machined from bulk silicon. Spaced in the area of the intermediate zone 332 are a plurality of apertures 346 to allow fuel to flow through.

Figure 5:
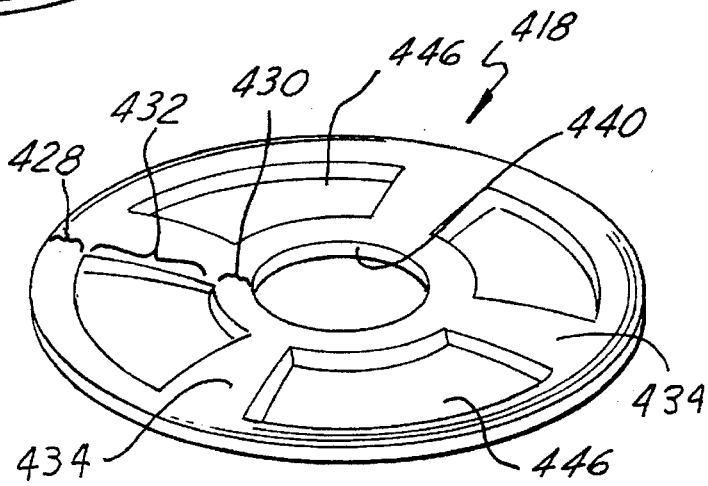
FIG. 5 is a perspective view of yet another embodiment of a guide diaphragm according to the invention.

Referring now to FIG. 5, yet another embodiment of a diaphragm for a fuel injection valve according to the invention is shown and generally indicated by numeral 418. In this embodiment, the intermediate zone 432 is slightly arched or bowed between the inner zone 430 and the outer zone 428. The inner zone 430 is attached to needle 16 and the outer zone 428 is secured between the shoulder 27 in housing 12 and the valve seat 14. The diaphragm 418 operates in a manner similar to that of a snap disc or washer as the needle 16 and the armature 20 move between the first and second positions. The diaphragm 418 may also be constructed from a metal such as steel. In addition, apertures 446 allow fuel to flow through the diaphragm 418. The spring elements 434 function in a manner as do the spring elements 134.

In each of the embodiments, FIGS. 2–5, the needle aperture 40, 140, 240, 340 and 440 is sized so as to form an interference fit with the needle 16. In this manner, there is no sliding friction and wear between the needle and the diaphragm 18, 118, 218, 318, and 418, respectively.

Figure 6:
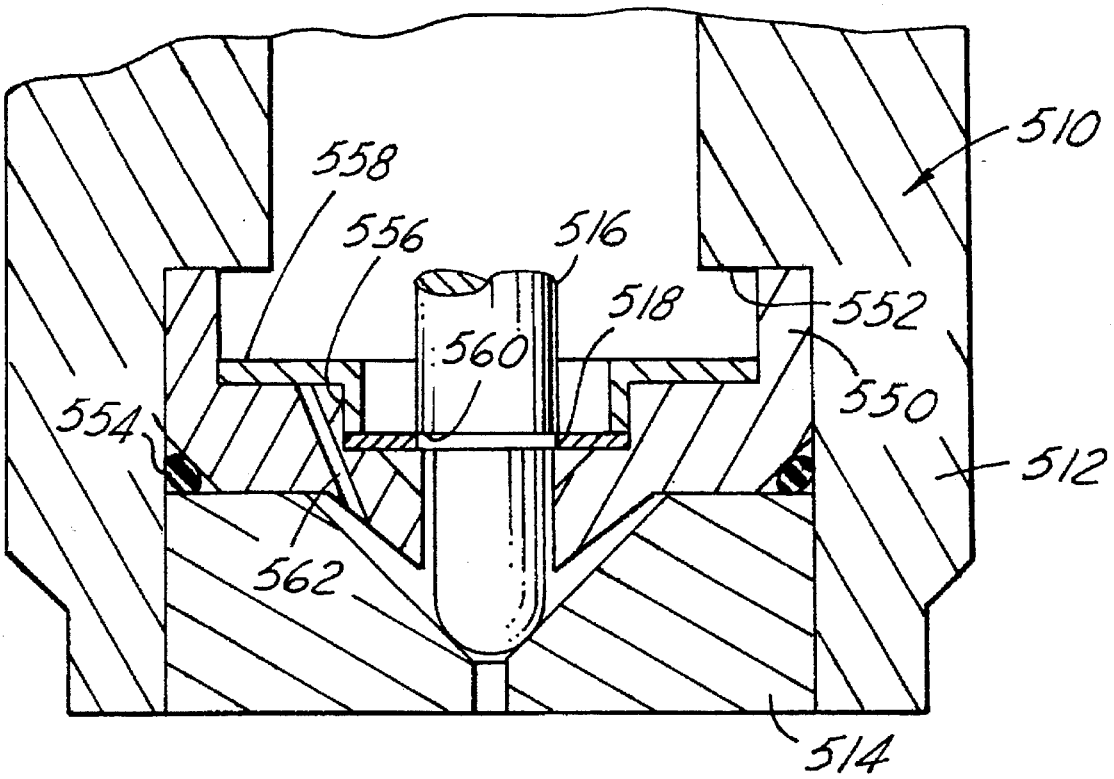
FIG. 6 is partial cross-sectional view of the nozzle end of a high pressure fuel injector.

Referring to FIG. 6, there is illustrated the nozzle end of a high pressure fuel injector 510 such as that illustrated in my U.S. Pat. No. 5,307,997 assigned to a common assignee and entitled "Fuel Injector Swirl Passages." In such an injector, it is necessary insure that no fuel leaks around the valve needle 516. In the injector illustrated in '997 patent, the lower guide is located between the top surface of the fuel swirl member and valve body member. The fuel swirl member is contained within the body member by a valve seat member.

Figure 7:
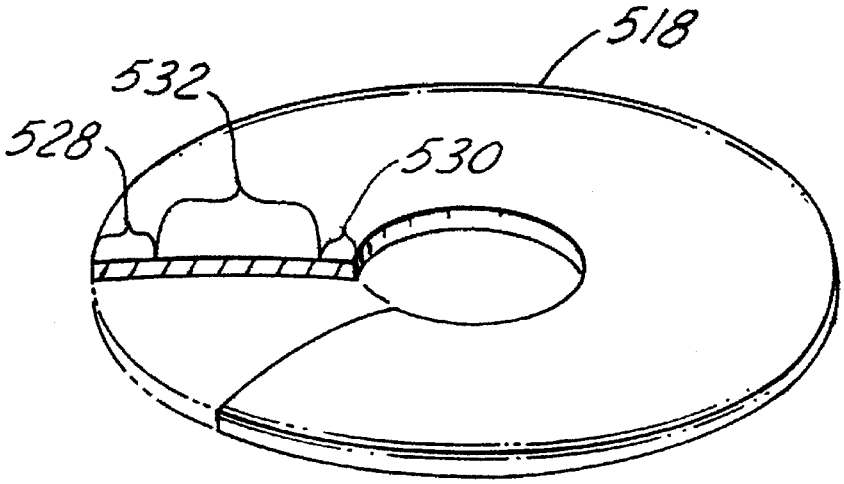
FIG. 7 is a perspective view of the guide diaphragm of FIG. 6.

In FIG. 6, the fuel swirl member 550 is located against a shoulder 552 of valve body 512 and is sealed by means of an O-ring 554 between the valve seat member 514 and the fuel swirl member 550. Both the valve seat member 514 and the fuel swirl member 550 are secured to the valve body 512 by suitable means. The guide diaphragm 518, one embodiment is shown in FIG. 7, is located in a counterbore 556 of the swirl member 550. At the bottom of the counterbore 556 there is a champer which allows the snap action of the guide diaphragm to function. A keeper member 558 operates to retain the diaphragm against the bottom of the counterbore.

The guide diaphragm 518, is an over-the-center snap-action guide as that illustrated in FIG. 5 but without any of the apertures 446. The guide diaphragm can also be similar to that illustrated in FIG. 4 but without any of the apertures 346. The snap-action guide diaphragm 518 has the three zones 528, 530 and 532. These zones are similar to the three zones of FIG. 5 wherein the outer zone 528 is secured by the keeper member 558 and the inner zone 530 encloses an aperture 540 which is in an interference fit with the needle 516. The intermediate zone 332 and 532 is essentially a soft spring wherein the radial force is low enough to allow the intermediate zone to move axially. This is true in all embodiments of the guide member. The aperture 540 is illustrated as being located against a shoulder 560 on the needle. This allows the guide diaphragm 518 to be placed on the needle and located thereon prior to being assembled in the fuel injector 510. The keeper 558, is secured to the swirl member and the guide diaphragm to locate and secure the diaphragm. The swirl member 550 has a plurality of inclined orifices 562 wherein the fuel is directed around the needle in a swirl pattern as described in the '997 patent. In order for the fuel to flow through the inclined orifices, the keeper 558 has a plurality of apertures or spokes so that the upstream opening of the orifices is free. In the alternate, the keeper can be a tubular member which is in an interference fit with the walls of the counterbore 556.

The present invention also includes a method for assembling a fuel injection valve 10 for an engine fuel injection system comprising a valve body 12, a valve seat 14 secured to the valve body 12, a valve needle 16 reciprocally movable in an axial direction and co-operably engageable with the valve seat 14 and a diaphragm 18 having an outer zone 28 and an inner zone 30. The method includes the steps of affixing the inner zone 30 of the diaphragm 18 through the valve aperture 40 to the needle 16 to form a needle and diaphragm assembly, assembling the needle and diaphragm assembly within the valve body 12, seating the valve needle 16 upon the valve seat 14 and thereafter securing the outer zone 28 of the diaphragm relative to the valve body 12 and the valve seat 14. The securing step may be performed by clamping the outer zone 28 of the diaphragm 18 between a shoulder 29 in the valve body 12 and the valve seat 14 while the valve needle is seated on the valve seat. This assures the proper alignment of the needle with the valve seat so that proper closing of the valve is assured.

Although the invention has been described by reference to a specific embodiment, it should be understood that numerous changes may be may within the spirit and scope of the inventive concepts described. Accordingly, it is intended that the invention not be limited to the described embodiment, but that it have the full scope defined by the language of the following claims.

What is claimed is:

1. A fuel injection valve for an engine fuel injection system, said fuel injection valve comprising:

a valve seat adapted to be fixedly secured to a valve body;

a valve needle reciprocally movable in an axial direction and cooperatively engageable with said valve seat; and a diaphragm that aligns said needle with said valve seat;

said diaphragm having an outer zone adapted to be secured to the valve body and an axially resilient intermediate zone radially extending from said outer zone; and characterized in that said diaphragm has an inner zone attached to said needle and to said intermediate zone such that said inner zone of said diaphragm moves in unison with said needle to avoid frictional sliding contact between said needle and said diaphragm and said intermediate zone includes a plurality radially extending curved spaced apart flexible spring members having a low radial force for allowing the intermediate zone to move axially.

2. A fuel injection valve for an engine fuel injection system, said fuel injection valve comprising:

a valve seat adapted to be fixedly secured to a valve body;

a valve needle reciprocally movable in an axial direction and cooperatively engageable with said valve seat; and a diaphragm that aligns said needle with said valve seat;

said diaphragm having an outer zone adapted to be secured to the valve body, an inner zone, and an axially resilient intermediate zone radially extending from said outer zone to said inner zone; and characterized in that said inner zone is attached to said needle to move in unison with said needle to avoid frictional sliding contact between said needle and said diaphragm; said intermediate zone applying a radial restraining force between said inner and outer zones by means of a plurality of spring elements to maintain axial alignment of said needle with said valve seat wherein each said spring element includes a diamond-shaped member having an opening therein.

3. A fuel injection valve for an engine fuel injection system, said fuel injection valve comprising:

a valve seat adapted to be fixedly secured to a valve body;

a valve needle reciprocally movable in an axial direction and cooperatively engageable with said valve seat; and a diaphragm that aligns said needle with said valve seat;

said diaphragm having an outer zone adapted to be secured to the valve body, an inner zone, and an axially resilient intermediate zone radially extending from said outer zone to said inner zone; and characterized in that said inner zone is attached to said needle to move in unison with said needle to avoid frictional sliding contact between said needle and said diaphragm; said diaphragm is constructed from silicon and said inner zone is metalized for attachment to said needle.

4. A fuel injection valve for an engine fuel injection system, said fuel injection valve comprising:

a valve seat adapted to be fixedly secured to a valve body;

a valve needle reciprocally movable in an axial direction and cooperatively engageable with said valve seat; and a diaphragm that aligns said needle with said valve seat;

said diaphragm having an outer zone adapted to be secured to the valve body, an inner zone, and an axially resilient intermediate zone radially extending from said outer zone to said inner zone; and characterized in that said inner zone is attached to said needle to move in unison with said needle to avoid frictional sliding contact between said needle and said diaphragm; said diaphragm is constructed from silicon and is formed by chemically micro-machining the silicon.

5. A fuel injection valve for an engine fuel injection system, said fuel injection valve comprising:

a valve body;

a valve seat fixedly secured to said valve body;

a solenoid;

an armature operable by said solenoid for axial movement between a first position and a second position;

a spring bias member operable to move said armature to said first position;

a valve needle attached to said armature for movement to cooperatively engage with said valve seat in said first position; and a silicon micro-machined guide diaphragm that aligns said needle with said valve seat, said guide diaphragm having an outer zone attached to said body and an inner zone attached to said needle such that said inner zone of said guide diaphragm moves in unison with said needle to thereby avoid frictional sliding contact between said needle and said diaphragm and an intermediate zone having a plurality of equally and angularly spaced beams connecting said inner zone with said outer zone, each of said beams being a flexible member providing a low radial force for unrestricted axial movement of said needle between said first and second positions.

* * * * *